US007870982B2

(12) United States Patent
Dong et al.

(10) Patent No.: US 7,870,982 B2
(45) Date of Patent: Jan. 18, 2011

(54) UTILITY SHOULDER BELT

(75) Inventors: Ming Dong, Monmouth Junction, NJ (US); Stephen L. Kob, Brooklyn, NY (US); Purin Phanichphant, Seattke, WA (US); Jeremy W. Stone, San Jose, CA (US); Surya Swamy, San Jose, CA (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 910 days.

(21) Appl. No.: 11/752,078

(22) Filed: May 22, 2007

(65) Prior Publication Data

US 2008/0061094 A1 Mar. 13, 2008

Related U.S. Application Data

(60) Provisional application No. 60/803,078, filed on May 24, 2006.

(51) Int. Cl.
*A45F 3/14* (2006.01)

(52) U.S. Cl. ..... 224/257; 224/603

(58) Field of Classification Search ..... 224/257, 224/603–605, 264, 633, 261, 272, 578, 600, 224/628, 634, 660, 663, 676, 678, 679; 24/3.4; 150/107; 206/320

See application file for complete search history.

(56) References Cited

U.S. PATENT DOCUMENTS

| | | | | | |
|---|---|---|---|---|---|
| 745,866 | A * | 12/1903 | Laing | 224/602 |
| 3,931,917 | A * | 1/1976 | Zellmer | 224/602 |
| 4,722,464 | A * | 2/1988 | Wright | 224/602 |
| 5,031,808 | A * | 7/1991 | Dolenc | 224/482 |
| 5,746,365 | A * | 5/1998 | Scott | 224/676 |
| 5,763,330 | A * | 6/1998 | Bertolucci et al. | 442/65 |
| 6,311,336 | B1 * | 11/2001 | Gootrad | 2/251 |
| 6,371,346 | B1 * | 4/2002 | Sharma | 224/578 |
| 6,443,347 | B1 * | 9/2002 | Elizalde et al. | 224/626 |
| 6,644,527 | B1 * | 11/2003 | Karenga | 224/602 |
| 6,886,726 | B1 * | 5/2005 | O'Hare | 224/576 |
| 2002/0162871 | A1 * | 11/2002 | Vigny | 224/628 |

* cited by examiner

*Primary Examiner*—Nathan J Newhouse
*Assistant Examiner*—Corey N Skurdal
(74) *Attorney, Agent, or Firm*—Jeffrey P. Calfa; Mark C. Bach

(57) ABSTRACT

A utility shoulder belt (10) configured to be slung over a user's shoulder and across a user's chest includes an elongate strap (12) with a first end and a second end (18) configured to be coupled to each other. The strap (12) has an interior surface (59) to be placed against the user and an exterior surface (57) opposite the interior surface. A support frame assembly (14) is attached to the strap (12) and outwardly extends from the exterior surface (57) of the strap, and a pocket assembly (16) is disposed between the strap and the support frame assembly.

15 Claims, 5 Drawing Sheets

UTILITY SHOULDER BELT

CROSS REFERENCE TO RELATED APPLICATION

This application claims priority from U.S. provisional patent application Ser. No. 60/803,078 filed May 24, 2006, which is specifically incorporated by reference. The present application is related to Design Application No. 29/280,264 titled "Utility Shoulder Belt" filed on May 22, 2007, which is specifically incorporated by reference.

FIELD OF THE INVENTION

The present invention relates generally to utility belts, and more particularly, to a utility belt that is slung over the shoulder and across the chest of the user.

BACKGROUND OF THE INVENTION

Utility belts are conventionally constructed of a leather strap with a buckle. The strap includes pockets, loops or other structures attached to the strap for positively retaining items to the belt. While utility belts are frequently made of leather, belts are also made of other materials such as fabrics and plastics.

Typically, the utility belt is worn by the user while performing a task, and the items stored in the utility belt are tools needed by the user to perform the task. Utility belts are not usually worn for storage of items needed for everyday tasks, for example for storing a mobile phone, money or a digital music player.

Further, utility belts are typically worn around the user's waist or on the user's side hip bones, which offers little support to the wearer's back. Additionally, the storage of items in a utility belt around the waist can be bulky and inconvenient.

SUMMARY OF THE INVENTION

A utility shoulder belt configured to be slung over a user's shoulder and across a user's chest includes an elongate strap with a first end and a second end configured to be coupled to each other. The strap has an interior surface to be placed against the user and an exterior surface opposite the interior surface. A support frame assembly is attached to the strap and outwardly extends from the exterior surface of the strap, and a pocket assembly is disposed between the strap and the support frame assembly.

DESCRIPTION OF A PREFERRED EMBODIMENT

Figure 1:
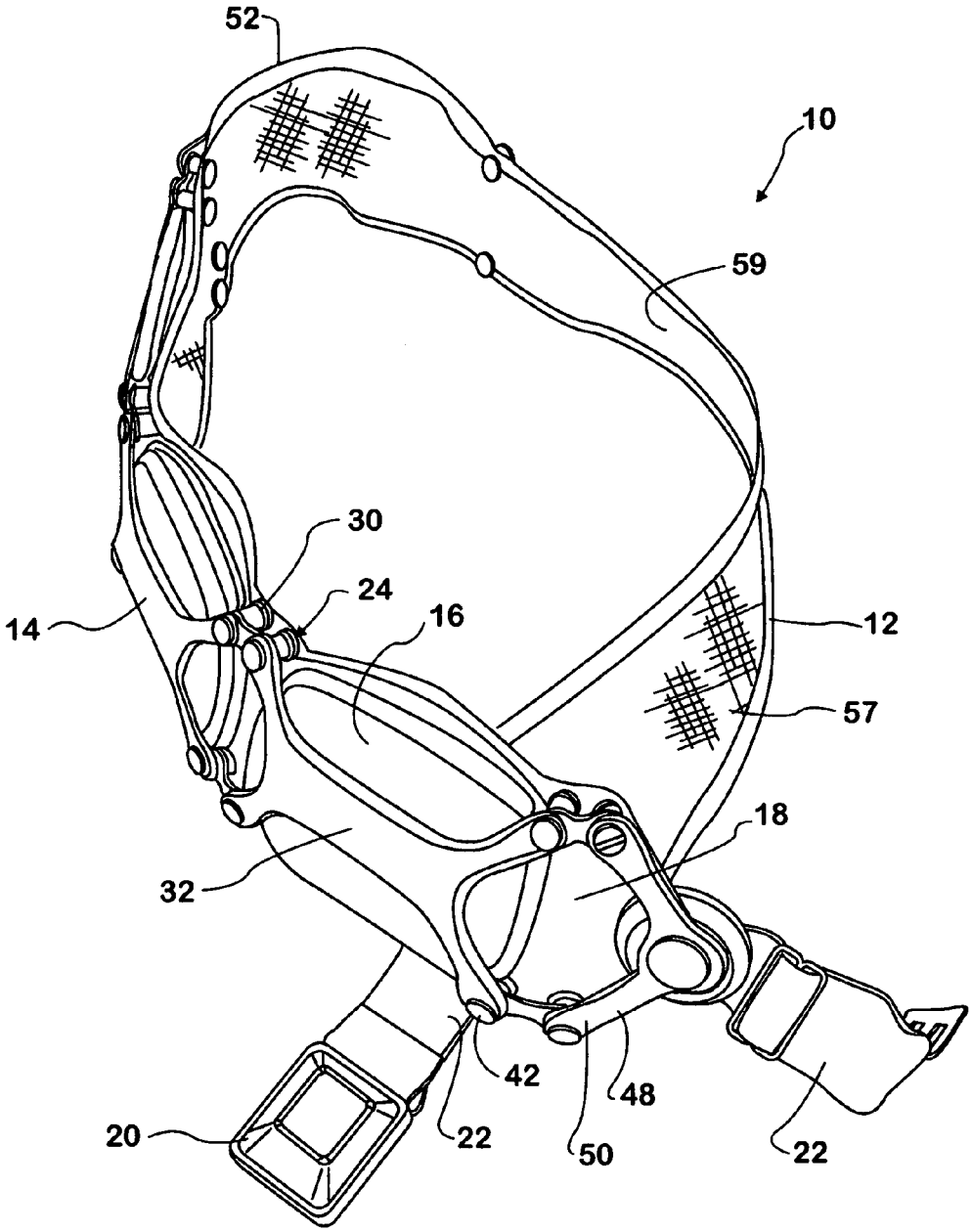
FIG. 1 is a front perspective view of a utility shoulder belt in accordance with the invention.

Referring to FIG. 1, a utility shoulder belt is indicated generally at 10, and includes a strap 12 and a support frame assembly 14 attached thereto. The support frame assembly 14 is attached to the strap 12 and houses at least one pocket assembly 16 for storage of items, such as mobile phones, digital music players, identification cards, credit cards and money.

The utility shoulder belt 10 is worn across the shoulder and chest of the user like a sash, and ends 18 of the belt are attached to each other with a buckle 20. In the embodiment of FIG. 1, the buckle 20 is an automotive buckle with an associated "seat-belt" type strap 22 that securely locks the ends of the strap 12 together in a simple and convenient manner, however other buckles are contemplated. Further, the large size and weight of the automotive buckle 20 tends to keep the ends 18 of the strap 12 located adjacent the waist of the user, and consequently, tends to prevent the utility shoulder belt 10 from twisting around the body of the user. The length of the strap 12 can be adjusted at the buckle 18 for changes in tightness, as is conventionally known.

Figure 2:
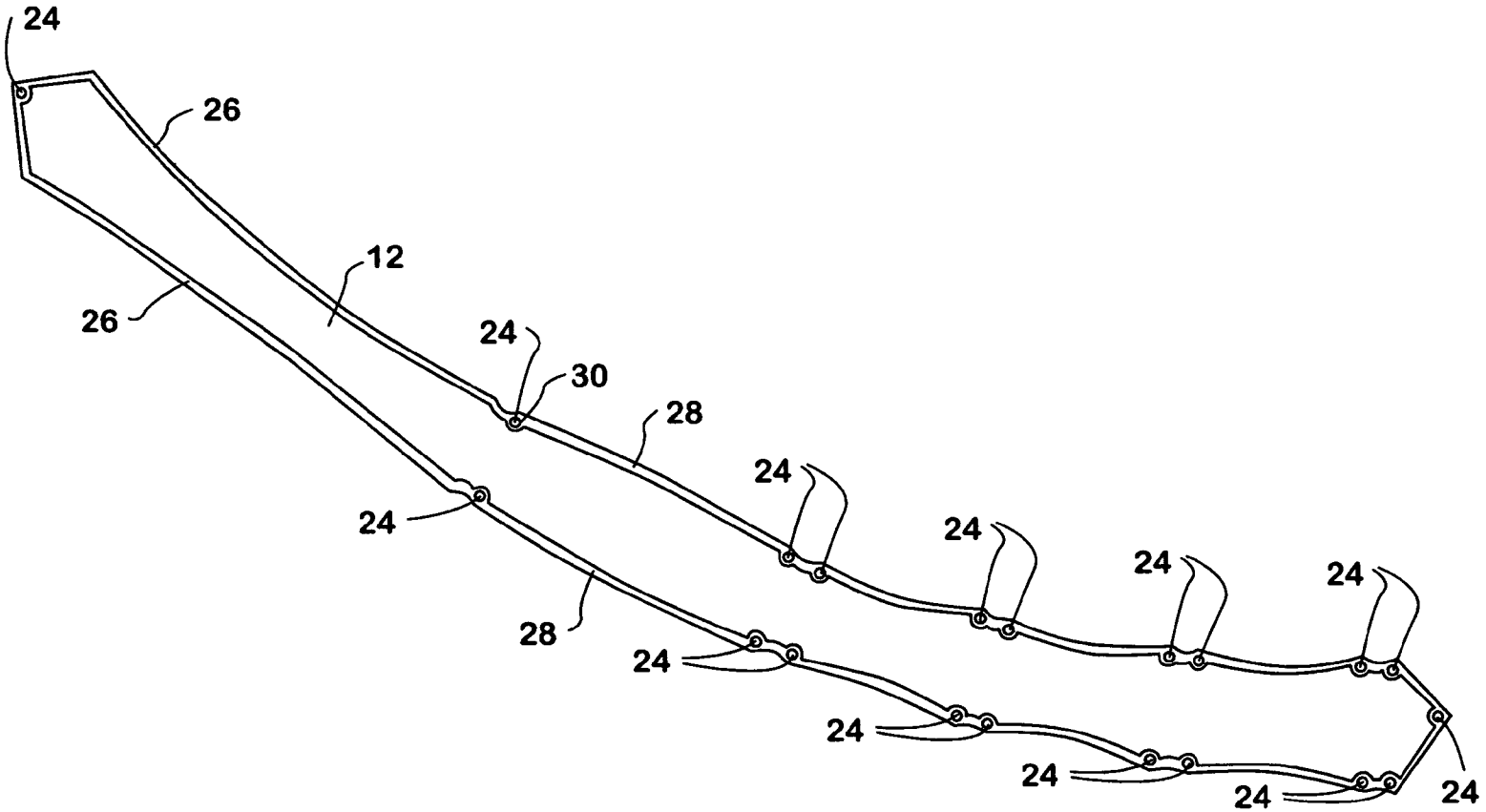
FIG. 2 is a top plan view of a strap of the utility shoulder belt in accordance with the invention.

Referring now to FIGS. 1 and 2, the strap 12 of the utility shoulder belt 10 has a plurality of holes 24 for receiving the support frame assembly 14. Advantageously, the strap 12 is constructed of a semi-stiff, polyester mesh in combination with a fiberglass mesh along the length of the sash, where the layer of semi-stiff mesh is sandwiched between two layers of the fiberglass mesh, however other materials are contemplated. With the mesh fabric, the strap 12 allows for breathability in addition to being slightly stretchable. Advantageously, a thin strip of elastic material 26 covers the strap edges 28.

The plurality of holes 24 are located on the side edges 28 of the strap and spaced according to the connection points of the support frame assembly 14. Metal eyelets 30 are disposed in each hole 24 to prevent tearing of the strap 12 mesh fabric.

Figure 3A:
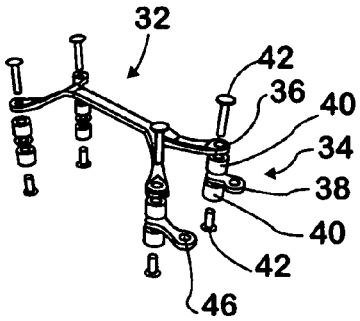
FIG. 3A is a front exploded view of a frame of the utility shoulder belt in accordance with the invention.
Figure 3B:
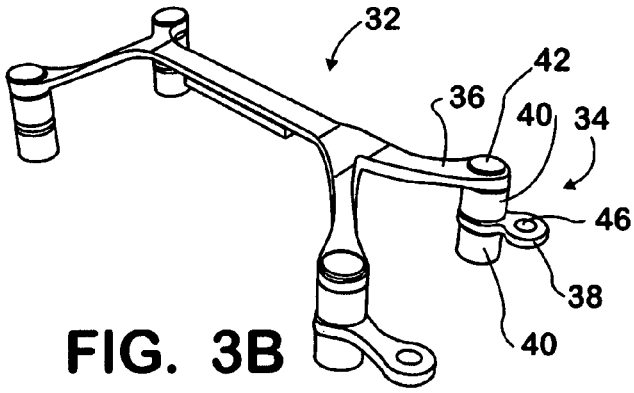
FIG. 3B is a front perspective view of the frame in accordance with the invention.

Referring now to FIGS. 3A and 3B, a frame 32 of the support frame assembly 14 is generally "X"-shaped and includes a plurality of end connectors 34 at each end 36 of the "X"-shape. The end connectors 34 are constructed of a link 38 disposed between two spacers 40, and held together with a fastener 42.

The fasteners 42 are advantageously threaded aluminum screws that are first introduced through the hole 24 (FIG. 2) of the main strap 12 before being engaged with the end connectors 34. The frame 32 and the end connectors 34 are advantageously formed of Low Density Polyethylene Plastic (LDPE), however other materials are contemplated. The spacers 40 are advantageously small plastic cylinders that space the frame from the strap 12.

The links 38 are configured to connect two adjacent frames 32 together, or two adjacent portions of the support frame assembly 14 together. The links 38 are generally "figure 8"-shaped, with each hole 46 of the "figure 8" being received in adjacent portions of the frame assembly 14.

Figure 4A:
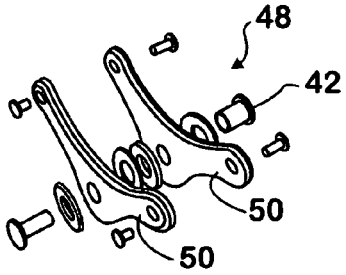
FIG. 4A is a rear exploded view of an end coupling assembly of the utility shoulder belt in accordance with the invention.
Figure 4B:
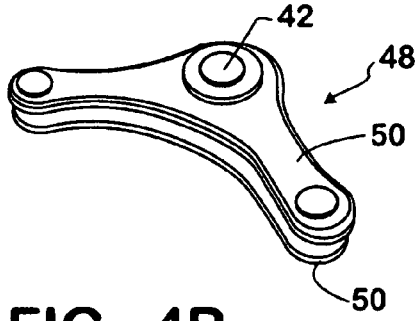
FIG. 4B is a front perspective view of the end coupling assembly in accordance with the invention.

Referring to FIGS. 4A-4B, an end coupling assembly 48 of the support frame assembly 14 includes two angled members 50 that generally correspond in shape to the two ends 18 of the strap 12. The two angled members 50 are connected to each other and to the strap 12 with a plurality of fasteners 42.

When assembled, the end coupling assembly 48 couples the ends 18 of the strap 12 to the buckle 20. Specifically, the strap 22 of the buckle 20 and the strap 12 are coupled to each other at the end coupling assembly 48.

Figure 5A:
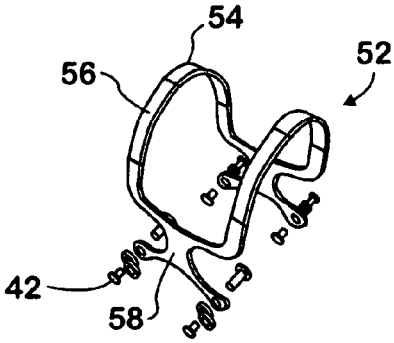
FIG. 5A is front exploded view of a shoulder piece assembly of the utility shoulder belt in accordance with the invention.
Figure 5B:
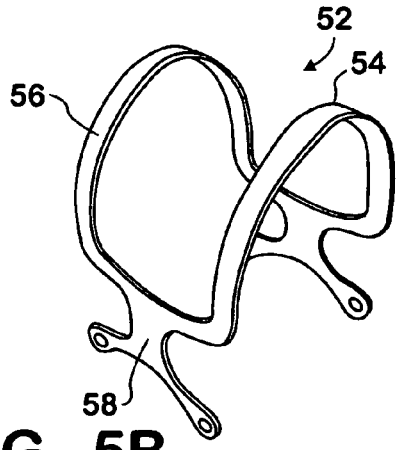
FIG. 5B is a front perspective view of the shoulder piece assembly in accordance with the invention.

Referring now to FIGS. 5A-5B, a shoulder piece assembly 52 of the support frame assembly 14 includes a generally curved frame 54 with an upper portion 56 that generally corresponds to the shape of a user's shoulder. A lower portion 58 of the shoulder piece assembly 52 is configured to receive a plurality of fasteners 42 to attach the shoulder piece assembly to the strap 12.

The shoulder piece assembly 52, at least one frame 32 and the end coupling assembly 48 are attached to each other to form the support frame assembly 14, which extends outwardly from an exterior surface 57 of the strap 12. The exterior surface 57 is opposite an interior surface 59, which is configured to be adjacent the user when the utility shoulder belt 10 is worn. As shown in FIG. 1, the shoulder piece assembly 52 is attached to a first frame 32, which is in turn linked to two subsequent frames, which is in turn linked to the end coupling assembly 48. Each of the shoulder piece assembly 52, the frames 32, and the end coupling assembly 48 are attached to the strap 12 at the holes 24. At least one pocket assembly 16 is disposed between the frame 32 and the strap 12.

Figure 6A:
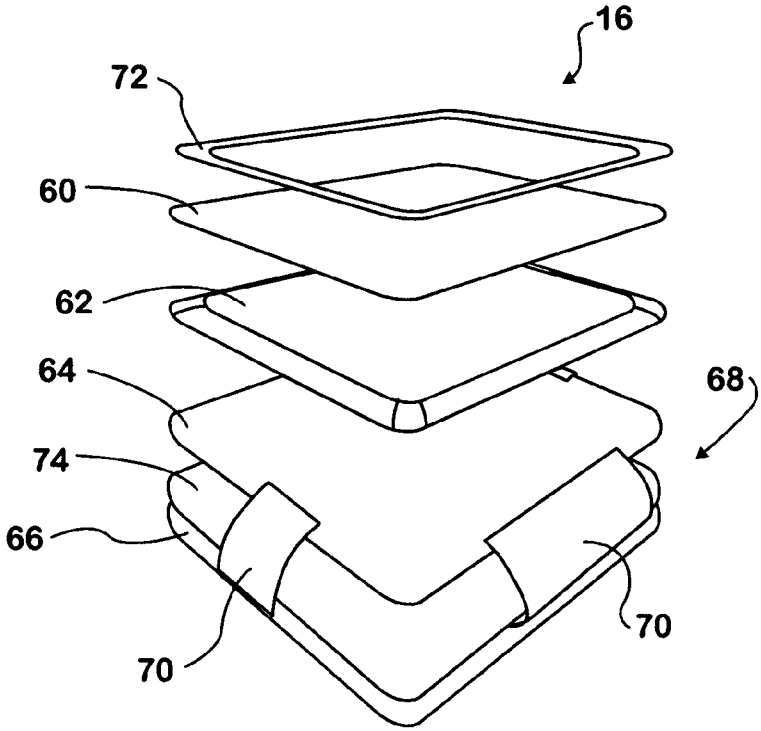
FIG. 6A is side exploded view of a pocket assembly in accordance with the invention.
Figure 6B:
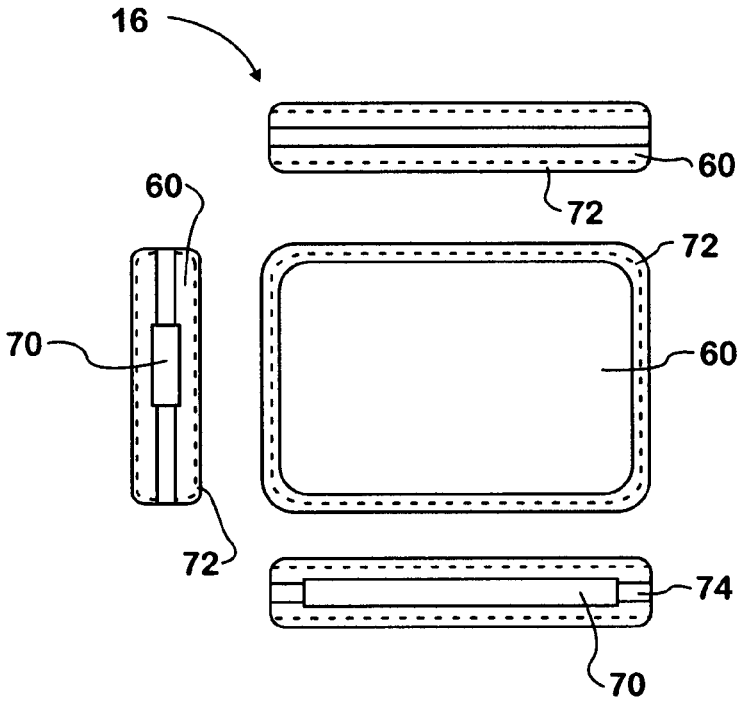
FIG. 6B is a front, top, bottom and side plan view of the pocket assembly in accordance with the invention.

In FIGS. 6A-6B, the pocket assembly 16 is made of four layers of fabric. In one embodiment, a top layer 60 is carbon fiber fabric, which lays over a secondary layer 62 of chipboard. The secondary layer 62 provides structure and form to the pocket assembly 16. The top layer 60 of carbon fiber is strong and lightweight, and also shields items from unwanted contact. Additionally, the layers 60, 62 can be waterproof.

Two layers 64, 66 of leather form a pocket 68, and the first leather layer is stitched to the chipboard. Three elastic straps 70 hold the two leather layers 64, 66 together and allows the pocket 68 to stretch and close properly. Each pocket assembly 16 advantageously has an interior pocket 74 of mesh disposed inside the leather layers 64, 66 that is sealed using a small waterproof zipper (not shown). As a decorative feature, an exterior layer 72 of nylon can be attached on top of the top layer 60.

The pocket assemblies 16 are securely attached to the support frame assembly 14, such as with adhesive, lifting them off the user's body and off the strap 12. When the pocket assemblies 16 are supported on the support frame assembly 14, air flow is permitted between the pocket assemblies and the strap 12. Alternately, the pocket assemblies 16 can be attached to the strap 12, such as with a sewn connection.

Figure 7:
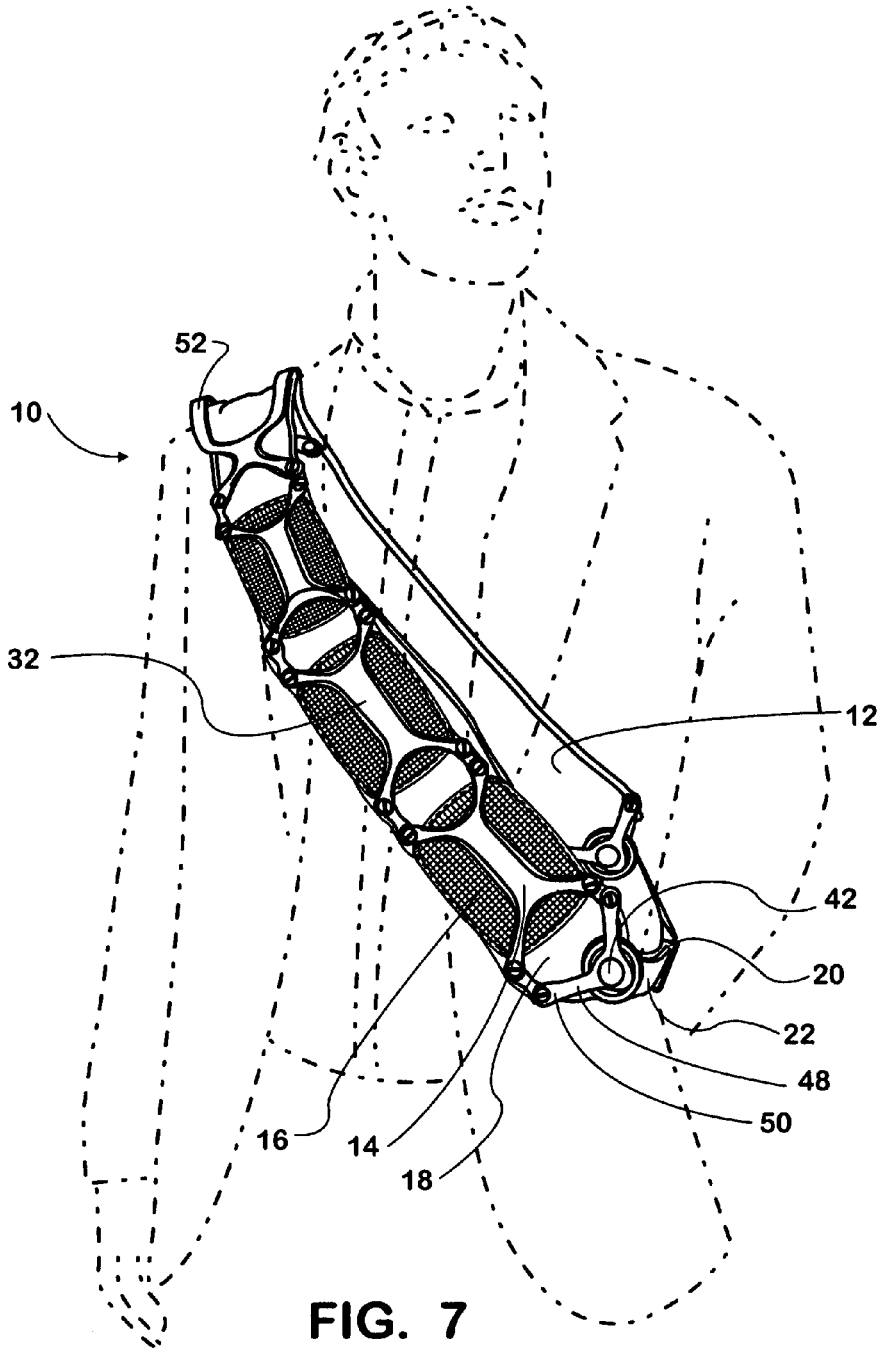
FIG. 7 is a side perspective view of the utility shoulder belt on a user in accordance with the invention.

Referring now to FIG. 7, advantageously there are three pocket assemblies 16 to provide storage for daily items. Each pocket assembly 16 can be the same size or a different size to accommodate a range of stored item sizes. The utility shoulder belt 10 allows the user to accessibly store items at the location of the user's chest. Further, the utility shoulder belt 10 is comfortable when worn across the user's shoulders and chest. Further still, the utility shoulder belt 10 is adjustable to accommodate a range of chest and shoulder sizes.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A utility shoulder belt configured to be slung over a user's shoulder and across a user's chest, comprising:

an elongate strap with a first end and a second end configured to be coupled to each other, the strap having an interior side to be placed against the user and an exterior surface opposite the interior surface;

a support frame assembly attached to the strap and outwardly extending from the exterior surface of the strap;

a pocket assembly disposed between the strap and the support frame assembly, wherein the support frame assembly comprises a frame and at least one end connector, and wherein the end connector comprises a link disposed between two spacers and attached to each other and the strap with a fastener.

2. The utility shoulder belt of claim 1 wherein the support frame assembly comprises a shoulder piece assembly having a generally curved frame with an upper portion that generally corresponds to the shape of a user's shoulder.

3. The utility shoulder belt of claim 2 wherein the shoulder piece assembly further comprises a lower portion configured to receive at least one fastener to attach the shoulder piece assembly to the strap.

4. The utility shoulder belt of claim 1 wherein the frame is generally "X"-shaped.

5. The utility shoulder belt of claim 1 wherein the support frame assembly comprises an end coupling assembly.

6. The utility shoulder belt of claim 1 wherein the support frame assembly comprises a shoulder piece assembly, at least one frame, and a coupling mechanism attached to each other.

7. The utility shoulder belt of claim 1 wherein the pocket assembly comprises a first layer and a second layer with elastic attached to at least one side of the first layer and the second layer to form a pocket.

8. The utility shoulder belt of claim 7 wherein said pocket assembly further comprises an interior pocket disposed inside the first and second layers.

9. The utility shoulder belt of claim 7 wherein said pocket assembly further comprises a top layer attached to a secondary layer attached to the pocket.

10. The utility shoulder belt of claim 9 wherein the pocket is leather, the top layer is fabric, and the secondary layer is chipboard.

11. The utility shoulder belt of claim 1 wherein the support frame assembly is Low Density Polyethylene Plastic.

12. The utility shoulder belt of claim 1 wherein the strap is a mesh fabric.

13. The utility shoulder belt of claim 1 wherein a buckle is attached to the first and second ends of the straps.

14. The utility shoulder belt of claim 12 wherein the buckle is an automotive or "seatbelt" buckle.

15. The utility shoulder belt of claim 1 wherein the pocket assembly is attached to the support frame assembly to lift the pocket assembly off of the strap.

* * * * *